US005647098A

United States Patent [19]

Leifeld et al.

[11] Patent Number: 5,647,098

[45] Date of Patent: Jul. 15, 1997

[54] APPARATUS FOR TRANSPORTING A COILER CAN BETWEEN A SLIVER-PRODUCING AND A SLIVER-CONSUMING TEXTILE MACHINE

[75] Inventors: Ferdinand Leifeld, Kempen; Stefan Schlichter, Viersen, both of Germany

[73] Assignee: Trützschler GmbH & Co. KG, Mönchengladbach, Germany

[21] Appl. No.: 455,527

[22] Filed: May 31, 1995

[30] Foreign Application Priority Data

Jul. 30, 1994 [DE] Germany ..... 44 27 123.9

[51] Int. Cl.[6] ..... B65H 54/80

[52] U.S. Cl. ..... 19/159 A

[58] Field of Search ..... 19/159 A, 159 R; 242/35.5 A, 129; 57/28, 127.7, 127.5, 90; 414/539, 467, 507, 525.1, 622, 786

[56] References Cited

U.S. PATENT DOCUMENTS

| | | | |
|---|---|---|---|
| 1,636,574 | 7/1927 | Perry | 414/467 |
| 4,194,866 | 3/1980 | Fritschi et al. . | |
| 4,272,867 | 6/1981 | Schopper | 19/159 R |
| 5,228,824 | 7/1993 | Satoyoshi | 414/352 X |
| 5,276,947 | 1/1994 | Fritschi et al. . | |
| 5,320,475 | 6/1994 | Pinder | 414/389 X |
| 5,359,753 | 11/1994 | Leifeld et al. | 414/467 X |

FOREIGN PATENT DOCUMENTS

| | | | |
|---|---|---|---|
| 0 621 358 | 10/1994 | European Pat. Off. . | |
| 35 05 494 | 9/1986 | Germany . | |
| 40 16 274 | 11/1991 | Germany . | |
| 41 27 292 | 2/1993 | Germany . | |
| 43-6321 | 8/1968 | Japan | 19/159 A |
| 1 296 523 | 11/1972 | United Kingdom . | |
| 2 034 775 | 6/1980 | United Kingdom . | |

*Primary Examiner*—Ismael Izaguirre
*Attorney, Agent, or Firm*—Spencer & Frank

[57] ABSTRACT

A system for transporting sliver between a sliver-producing textile machine and a sliver-consuming textile machine includes a coiler can containing the sliver; a carriage for transporting the coiler can; and a can-handling arrangement for moving the coiler can onto and off the carriage. The can-handling arrangement has a can-pusher for tilting the coiler can standing externally of the carriage on an emplacement and a device for reaching underneath the can bottom.

10 Claims, 3 Drawing Sheets

8
8'
8''
8'''
9
10
13a
15
1b
A
C
D
F
G
H
I
α

APPARATUS FOR TRANSPORTING A COILER CAN BETWEEN A SLIVER-PRODUCING AND A SLIVER-CONSUMING TEXTILE MACHINE

CROSS-REFERENCE TO RELATED APPLICATION

This application claims the priority of German Application No. P 44 27 123.9 filed Jul. 30, 1994, which is incorporated herein by reference.

BACKGROUND OF THE INVENTION

This invention relates to an apparatus for transporting a coiler can between a sliver-producing fiber processing machine, such as a carding machine or a drawing frame and a sliver-consuming fiber processing machine, such as a drawing frame or a spinning machine. The apparatus includes a transport carriage associated with a can-shifting device for loading a can onto or unloading a can from the carriage. The shifting device includes elements for grasping the can and also has linearly displaceable shifting elements for moving the can relative to the carriage.

In a known apparatus, by means of a shifting device mounted on the carriage, the sliver-filled coiler can is moved onto or an empty coiler can is moved off the carriage. A gripper is provided which has two horizontal telescoping cylinders. At one end of the cylinder piston a pressure cylinder is arranged at an angle of 90° which operates in the radial direction of the can and clamps the can against the other pressure cylinder situated diametrically opposite, on the other side of the can. The gripping device has two short, arcuate clamping members which are adapted to the curvature of the outer surface of the coiler can. First the clamping parts are moved in a linear direction tangentially to the coiler can in such a manner that the can will be situated between the clamping members. Between the clamping members and the outer surface of the coiler can only small clearances are present. The clamping parts are short to ensure that the can will fit therebetween upon grasping. The length of stroke of the pressure cylinder situated transversely to a horizontal telescoping cylinder is also short. Thereafter the coiler can is, as the pressure cylinder moves radially in the direction of the can, clamped firmly by the clamping components in a frictional manner.

The above-outlined prior art apparatus has several disadvantages:

The grasping of the coiler can requires an accurate movement of the carriage to the location (can emplacement) where can shifting occurs because the coiler can has to be positioned with small lateral clearances in the intermediate space between the facing clamping components (x-direction). Further, the telescoping cylinders with the clamping components have to be positioned accurately relative to the coiler can (y-direction), so that the short clamping components may securely grasp the outer can surface. Such a precise positioning of the clamping components in both the longitudinal and the transverse direction requires substantial technical and constructional outlay and furthermore may lead to operational disturbances.

SUMMARY OF THE INVENTION

It is an object of the invention to provide an improved apparatus or the above-outlined type from which the discussed disadvantages are eliminated and which, in particular, ensures a secure engagement and shifting of the cans in a simple and rapid manner.

This object and others to become apparent as the specification progresses, are accomplished by the invention according to which briefly stated the system for transporting sliver between a sliver-producing textile machine and a sliver-consuming textile machine includes a coiler can containing the sliver; a carriage for transporting the coiler can; and a can-handling arrangement for moving the coiler can onto and off the carriage. The can-handling arrangement is mounted on the carriage and has a mechanism for tilting the coiler can standing externally of the carriage on an emplacement and a mechanism for reaching underneath the can bottom.

The measures according to the invention ensure a secure engagement and shifting of the can onto and out of the carriage in a simple and rapid manner. It is an advantage of the invention that an exact positioning of the apparatus for the lateral tilting and underreaching of the can is facilitated. The invention has the following additional advantageous features:

- The device for the lateral tilting and underreaching is mounted on the carriage.
- The device for tilting is a pressure element such as a plunger, a pressing arm or the like movable laterally outwardly of the carriage.
- The tilting device is situated above the center of gravity of the can.
- A fixed counter support, such as a stop is provided at the emplacement for the can to abut a lower part of the can for assisting the tilting device in tipping the can.
- The underreaching device comprises a movable flat element such as a platform, a fork or the like extendable externally of the carriage.
- The tilting device and the underreaching device are movable in opposite lateral directions.
- A device is provided for lifting the can.
- The underreaching device is designed for lifting the can from below.
- The cans may be moved onto the carriage individually, consecutively or simultaneously.
- The coiler cans are moved from the carriage simultaneously.
- The cans are moved simultaneously onto the carriage and are thereafter individually unloaded from the carriage at different locations.
- The carriage has a throughgoing loading and unloading system for simultaneously moving a plurality of coiler cans.
- The carriage has an individual loading and unloading system for the individual cans and may be driven individually.
- The individual loading and unloading systems may be mechanically coupled to one another.
- The individual loading and unloading systems may be coupled to one another electrically.

DESCRIPTION OF THE PREFERRED EMBODIMENTS

Figure 1:
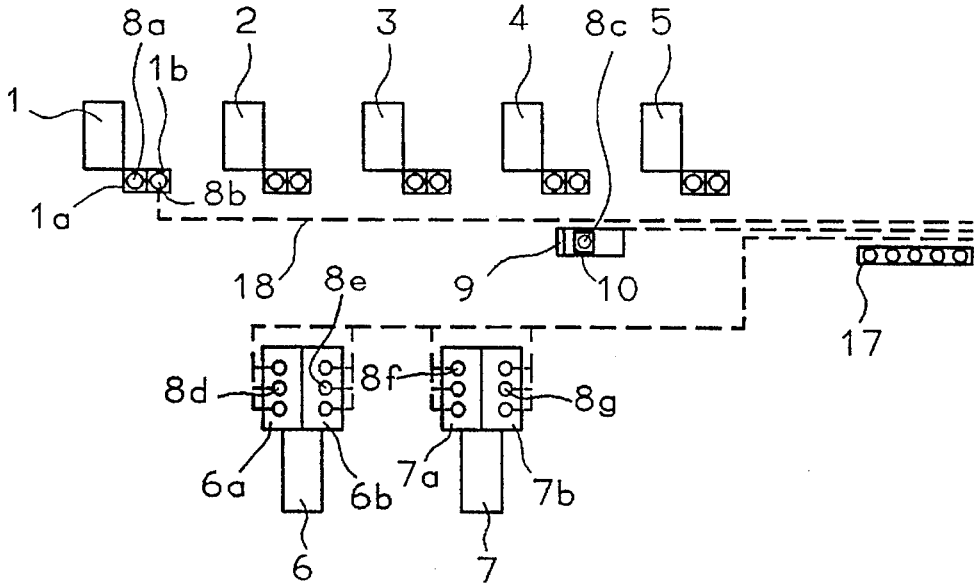
FIG. 1 is a schematic top plan view of a fiber processing system for spinning preparation, incorporating the invention.

Turning to FIG. 1, the system for the spinning preparation of fiber material includes five carding machines 1, 2, 3, 4 and 5 which may be of the EXACTACARD DK model manufactured by Trützschler GmbH & Co. KG, M önchengiadbach, Germany. The system further has two drawing frames 6 and 7. Each carding machine 1–5 is provided with a sliver coiler 1*a* which deposits sliver in a coiler can 8*a*. Adjacent each sliver coiler 1*a* a pick-up station 1*b* is arranged to position the coiler cans 8*b* charged with sliver. The sliver coiler 1*a* and the pick-up station 1*b* may form part of a conventional can exchanging device. For transporting a coiler can 8*c* between the carding machines 1–5 on the one hand and the drawing frames 6 and 7 on the other hand, a carriage 9 is provided which carries the coiler can 8*c* to a storage station 6*a* of the drawing frame 6 or a storage station 7*a* of the drawing frame 7. The six coiler cans designated at 8*d* and 8*f* (storage position) are at the same height as six additional filled coiler cans 8*e* and 8*g*, respectively. The coiler cans 8*e* and 8*g* are situated at the drawing frame input where the sliver is withdrawn simultaneously from a plurality of coiler cans and advanced to the drafting unit of the drawing frame 6 and 7 for doubling and drafting. It is to be understood that instead of three coiler cans 8*e* and 8*g* a larger or smaller number of coiler cans 8*e* and 8*g* may be set simultaneously at the input of the drawing frame 6 and 7 in case a different type of doubling is desired. There is further provided a can-accumulating station 17 which is situated between the cards and the drawing frames and which, in accordance with the type of sliver, may receive full and/or empty cans 8. The travel path of the carriage 9 is indicated by dashed lines 18.

Figure 2:
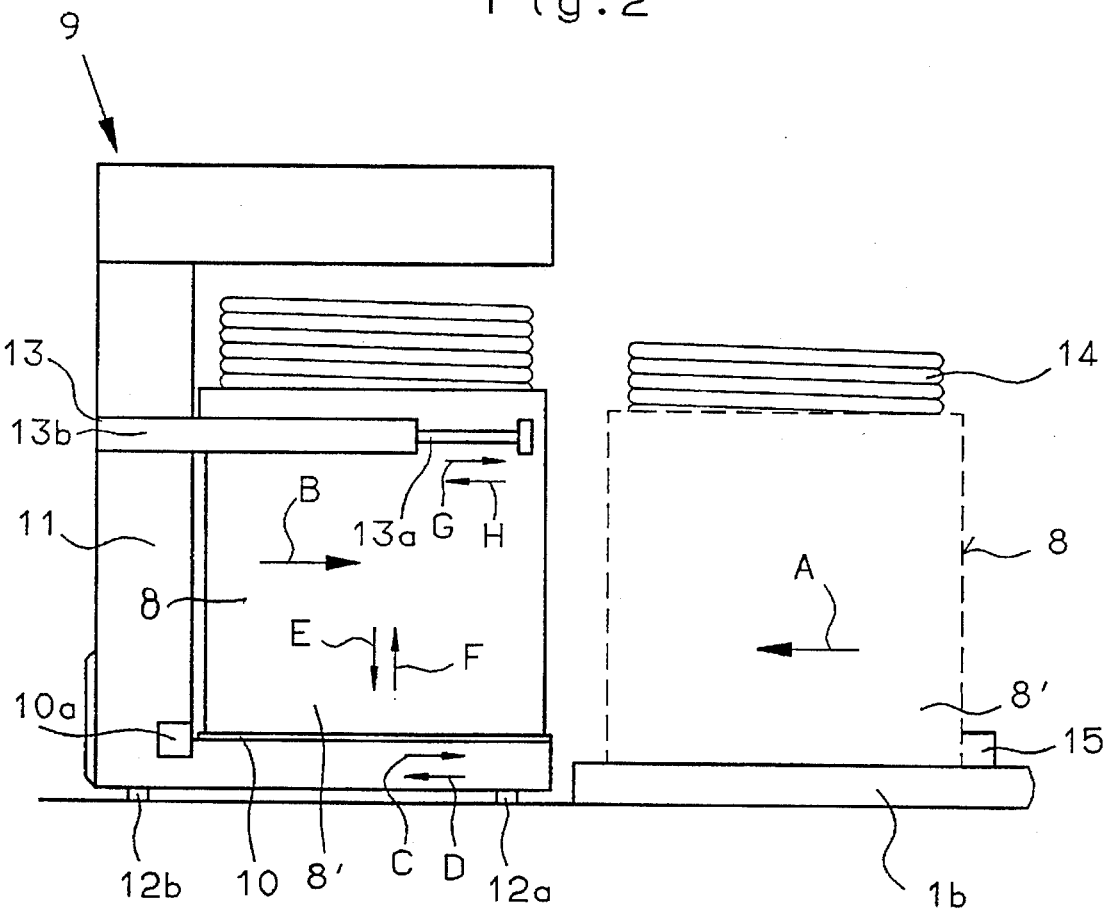
FIG. 2 is a side elevational view of a carriage situated at a can emplacement and having mounted thereon an apparatus according to the invention.

Turning to FIG. 2, there is illustrated the carriage 9 adapted to transport a can 8 having a diameter of approximately 1,000 mm. On the carriage 9 a loading and unloading device is mounted which includes a can-tilting device 13 having a can-pusher 13*a* and an underreaching device (platform) 10. The latter, on which the can stands when in the carriage 9, is about 120 mm above the ground.

The chassis 11 of the carriage 9 includes drives such as an electric motor for propelling the carriage, a pneumatic drive 13*b* for extending or retracting the can pusher 13*a* of the can tilting device 13, a power mechanism 10*a* for extending or retracting the platform 10, energy supply devices and the like. The chassis 11 moves by means of steerable axles having four wheels 12*a*, 12*b*, 12*c* and 12*d*. The coiler can is situated inside the carriage 9 between the carriage wheels.

The can 8 charged with sliver 14 is moved in the direction A towards the carriage 9 and in the direction B away therefrom. The sliding plate (platform) 10 is movable by the power mechanism 10*a* horizontally in the direction of the arrows C and D and vertically in the direction of the arrows E and F. The pusher 13*a* is movable in the direction of the arrows G and H.

As further illustrated in FIG. 2, the coiler can 8 shown in phantom lines is in the pick-up station (emplacement) 1*b*. To the emplacement a stop 15 is secured which contacts the lower zone 8' of the coiler can 8. The coiler can 8 shown in solid lines in FIG. 2 has already been placed on the carriage 9.

Figures 3A, 3B, 3C, 3D, 3E, 3F, 3G:
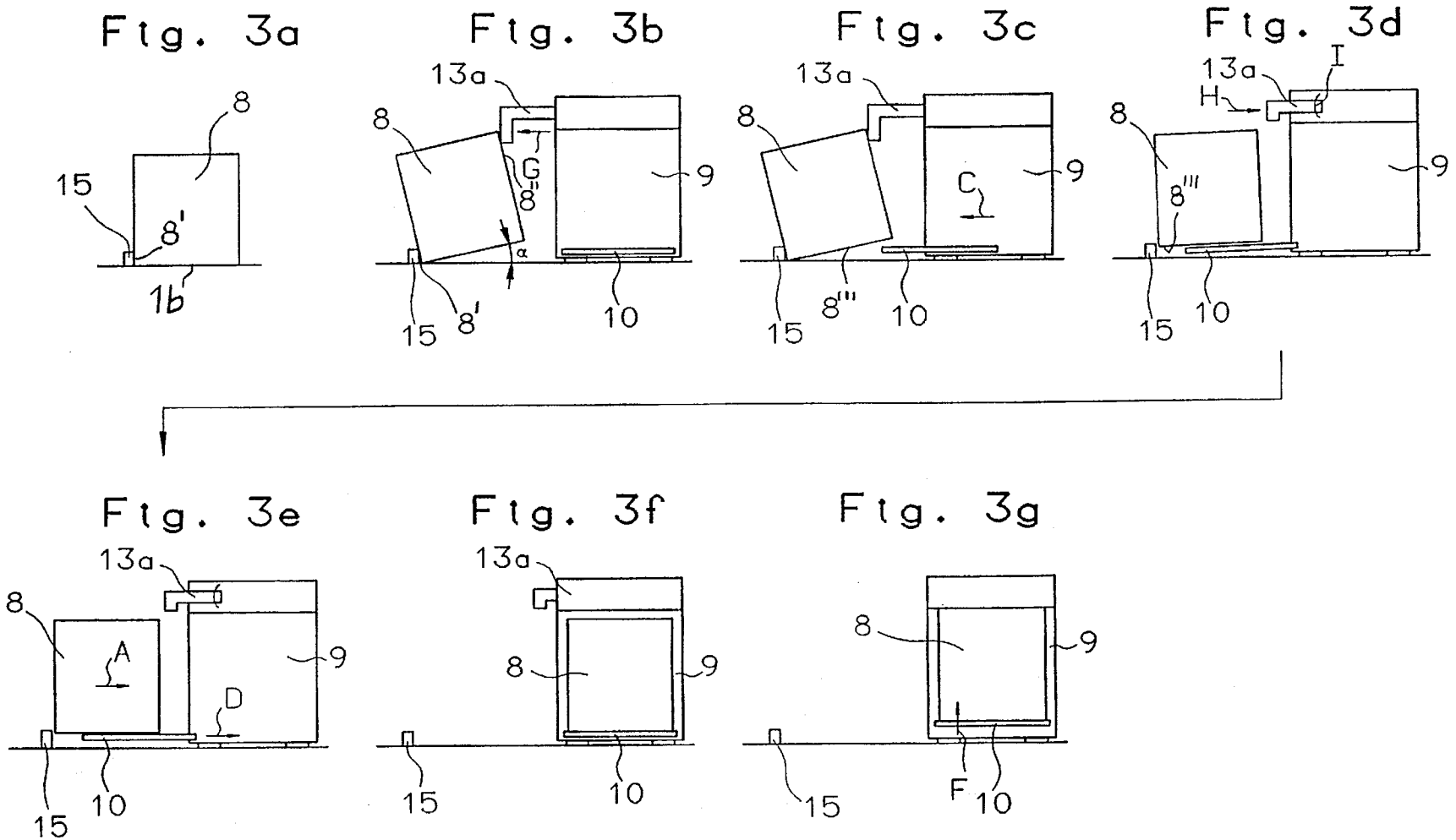
FIGS. 3*a*–3*g* are schematic side elevational views showing different operational positions of the apparatus according to the invention.

Turning to FIG. 3*a*, the coiler can 8 is situated on the can emplacement 1*b* (pick-up location), and lies, with its lower zone 8' against the stop (counter support) 15. According to FIG. 3*b*, the tilting plunger 13*a* mounted on the carriage 9 is extended in the direction G, presses against the upper surface zone 8" and thus tilts the coiler can 8 about an angle α. The can 8 remains in a stable position. Subsequently the platform 10 is extended in the direction C from the transport carriage 9, as shown in FIG. 3*c*, and reaches under the bottom 8'" of the coiler can 8. Thereafter the plunger 13*a* is, as shown in FIG. 3*d*, retracted in the direction of the arrow H so that the coiler can tilts back about the angle α and the can bottom 8'" lies on the slide plate (platform) 10. The plunger 13*a* is pivoted in the direction I so that the motion path for the can is clear. As shown in FIG. 3*d*, the plate 10 moves, together with the coiler can 8, in the direction D and in this manner, as shown in FIG. 3*f*, moves the coiler can 8 into the carriage 9. Subsequently, as shown in FIG. 3*g*, the slide plate 10 is, together with the coiler can 8, lifted as indicated by the arrow F. Thereafter the carriage 9 may travel to the subsequent (non-illustrated) station.

The removal of the coiler can 8 from the carriage 9 onto the emplacement 1*b* is performed in a reverse sequence, according to FIGS. 3*g*–3*a*.

Figure 4:
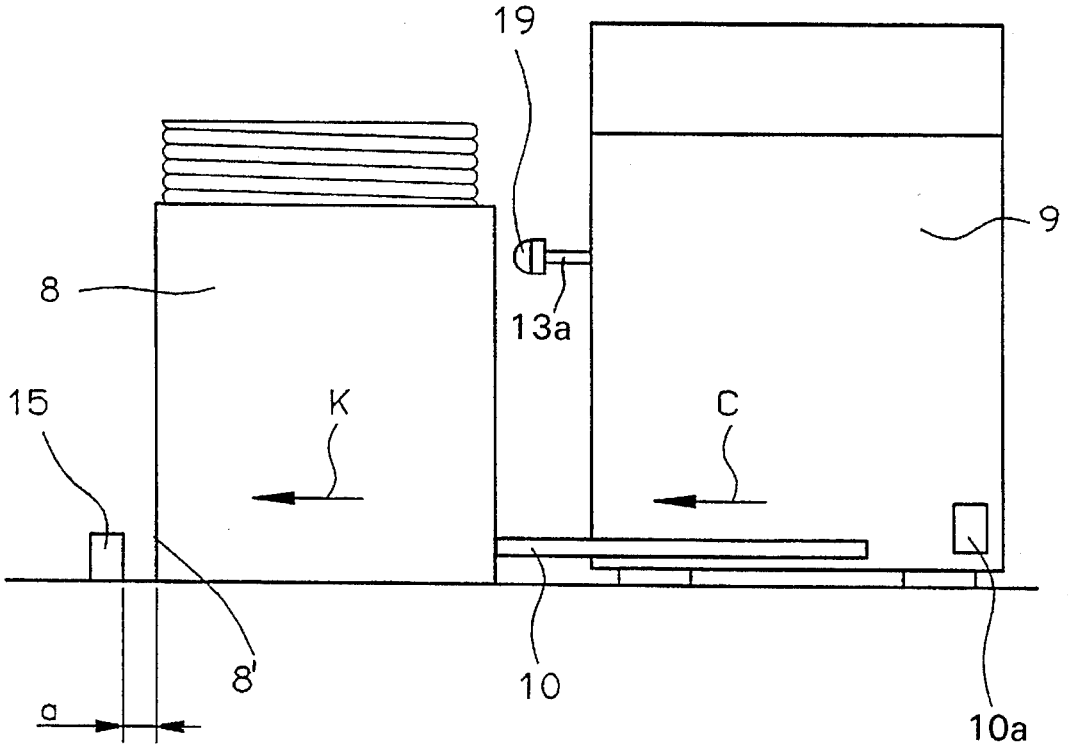
FIG. 4 is a side elevational view showing a carriage and a coiler can positioned adjacent an abutment.

In FIG. 4 between the lower can region 8' and the abutment (stop) 15 a clearance a is provided. In order to close the clearance a to thus ensure that the zone 8' lies in engagement with the abutment 15, the sliding plate 10 presses the can 8 in the direction K against the abutment 15. Further, a pusher 13*a* is shown which carries at its outer end a resilient engagement head 19.

Figure 5:
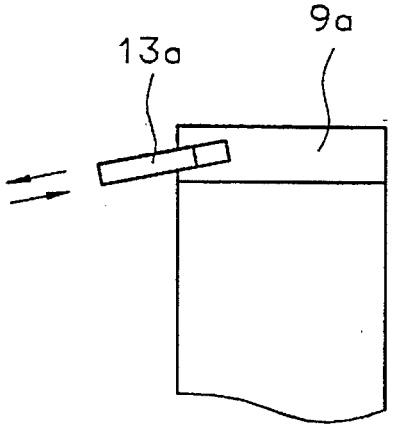
FIG. 5 is a fragmentary side elevational view of a carriage having a downwardly sloping pusher situated on an upper transverse part of the carriage.

In FIG. 5 the pusher 13*a* mounted in the transverse head 9*a* of the carriage 9 is arranged at a downwardly sloping orientation. If the pusher 13*a* is retracted, the travel path for the can into or out of the carriage is cleared.

Figure 6:
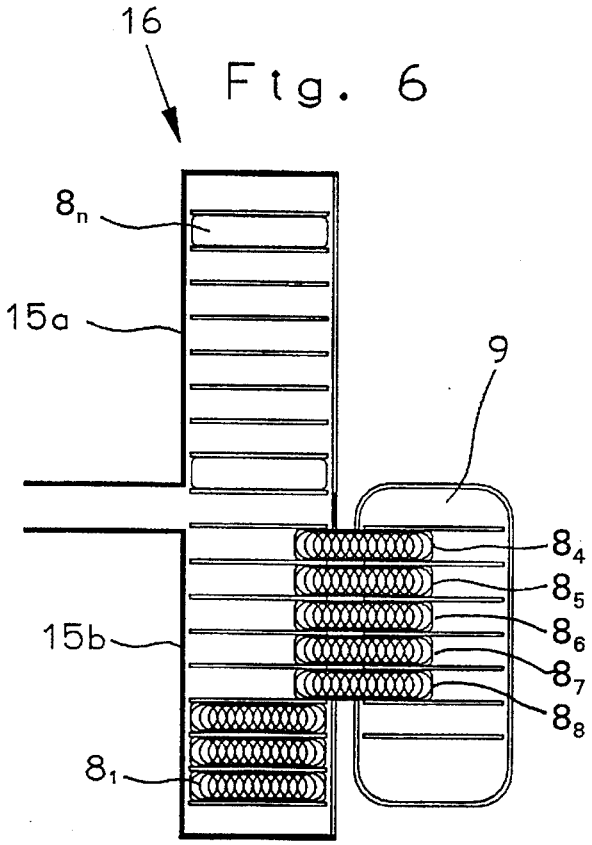
FIG. 6 is a schematic top plan view illustrating a carriage and emplacements for a plurality of flat coiler cans.

In FIG. 6 a variety of coiler cans $8_1$–$8_n$ (flat cans) are placed in a side-by-side series. The empty and full cans $8_1$–$8_n$ lie against an abutment (ledge) 15*a* and 15*b*, respectively. The carriage 9 is simultaneously charged with five full cans $8_4$–$8_8$ by means of the apparatus according to the invention. The can emplacement 16 is associated with a non-illustrated drawing frame. The emplacement may also be associated with a non-illustrated spinning machine such as a ring spinning machine or an open-end spinning machine.

It will be understood that the above description of the present invention is susceptible to various modifications, changes and adaptations, and the same are intended to be comprehended within the meaning and range of equivalents of the appended claims.

What is claimed is:

1. A system for transporting sliver between a sliver-producing textile machine and a silver-consuming textile machine, comprising (a) a coiler can containing the sliver; said coiler can having a can bottom and a center of gravity;

(b) a can emplacement;

(c) a carriage for transporting the coiler can; and (d) can-handling means mounted on said carriage for pushing said coiler can horizontally and, at the same time, preventing a horizontal motion thereof at a location below said center of gravity to effect tilting of said coiler can, for reaching underneath said can bottom in a tilted state of the coiler can to tilt back said coiler can, for moving the coiler can onto and off the carriage, and for vertically moving said coiler can in an untilted position.

2. The system as defined in claim 1, wherein said can handling means includes a pusher element mounted on said carriage and movable toward said emplacement laterally beyond said carriage for tilting said coiler can.

3. The system as defined in claim 2, wherein said pusher element is situated above said center of gravity.

4. The system as defined in claim 2, wherein said can-handling means comprises a stop affixed to said emplacement for abutting said coiler can below the center of gravity thereof when engaged and pushed by said pusher element.

5. The system as defined in claim 2, wherein said pusher element is movable in opposite lateral directions.

6. The system as defined in claim 1, wherein said can-handling means includes a can-bottom engaging element mounted on said carriage and movable toward said emplacement laterally to reach under said can-bottom.

7. The system as defined in claim 6, wherein said can-bottom engaging element comprises a flat platform.

8. The system as defined in claim 6, wherein said can-bottom engaging element is movable in opposite lateral directions.

9. The system as defined in claim 6, wherein said can-bottom engaging element includes means for lifting the coiler can and for moving the coiler can from said emplacement into said carriage.

10. A system for transporting sliver between a sliver-producing textile machine and a sliver-consuming textile machine, comprising (a) a plurality of coiler cans containing the sliver; each said coiler can having a can bottom and a center of gravity;

(b) a can emplacement;

(c) a carriage for transporting the coiler cans; and (d) can-handling means mounted on said carriage for simultaneously pushing said coiler cans horizontally and, at the same time, preventing a horizontal motion thereof at a location below said center of gravity to effect tilting of said coiler cans, for reaching underneath the can bottoms in a tilted state of the coiler cans to tilt back said coiler cans, for moving the coiler cans onto and off the carriage, and for vertically moving said coiler cans in an untilted position.

* * * * *